United States Patent [19]

Ishikawa et al.

[11] Patent Number: 4,560,919

[45] Date of Patent: Dec. 24, 1985

[54] CONSTANT-VOLTAGE CIRCUIT INSENSITIVE TO SOURCE CHANGE

[75] Inventors: Hitoshi Ishikawa; Kenji Kano, both of Itami, Japan

[73] Assignee: Mitsubishi Denki Kabushiki Kaisha, Tokyo, Japan

[21] Appl. No.: 644,434

[22] Filed: Aug. 27, 1984

[30] Foreign Application Priority Data

Nov. 30, 1983 [JP] Japan ..... 58-228028

[51] Int. Cl.[4] ..... G05F 3/18

[52] U.S. Cl. ..... 323/314; 323/316

[58] Field of Search ..... 323/299, 303, 313, 314, 323/315, 316

[56] References Cited

U.S. PATENT DOCUMENTS

| | | | |
|---|---|---|---|
| 4,085,359 | 4/1978 | Ahmed | 323/314 |
| 4,349,778 | 9/1982 | Davis | 323/314 |
| 4,352,056 | 9/1982 | Cave et al. | 323/314 |

OTHER PUBLICATIONS

"Voltage Regulator Handbook", National Semiconductor, p. 10.116 (LM342 Series), N. Sevastopoulos, Ed.

"Voltage Regulator Handbook", Japanese ed., Fairchild NDC 548, pp. 1–4 (μ A 723 Series), Jun. 10, 1979.

*Primary Examiner*—Peter S. Wong
*Assistant Examiner*—D. L. Rebsch
*Attorney, Agent, or Firm*—Lowe, King, Price & Becker

[57] ABSTRACT

A constant-voltage circuit includes a transistor (Q3) for output control connected between a source potential and a ground potential and a divider circuit (R1, R2, D2, D3) which are connected in series. The dividing point of the divider circuit connected between the emitter of the transistor (Q3) and the ground potential serves as an output terminal to be supplied with a predetermined voltage by the emitter of the transistor (Q3), so that a constant voltage appears at the output terminal. Connection between the base and the collector of the transistor (Q3) is so improved that the emitter voltage is not changed following a change in the source voltage. More specifically, the transistor (Q3) is connected in such a manner that the collector-to-emitter voltage is continuously clamped by the base-to-emitter voltage of the transistor (Q3), so that the transistor (Q3) is not subjected to a base width modulation effect and thus the emitter potential is not changed following the change in the source voltage.

16 Claims, 3 Drawing Figures

CONSTANT-VOLTAGE CIRCUIT INSENSITIVE TO SOURCE CHANGE

BACKGROUND OF THE INVENTION

The present invention relates to a constant-voltage circuit and, more particularly, it relates to a constant-voltage circuit which maintains a stable output characteristic with respect to changes in a source voltage.

DESCRIPTION OF THE PRIOR ART

FIG. 1 is a circuit diagram showing a typical example of a conventional constant-voltage circuit. In FIG. 1, a current mirror circuit is formed by transistors Q1 and Q2. The bases of the transistors Q1 and Q2 are interconnected with each other while a short circuit is formed between the base and the collector of the transistor Q2. The emitters of the transistors Q1 and Q2 are connected to a power source. The collector of the transistor Q1 is grounded through a Zener diode D1, while the collector of the transistor Q2 is grounded through a constant-current source C. The collector of the transistor Q1 is connected for output control with the base of a transistor Q3, whose collector in turn is connected to a power source and the emitter thereof is grounded through a divider circuit. The divider circuit is formed by series-connected resistors R1 and R2 and diodes D2 and D3, with the junction between the resistors R1 and R2 serving as a dividing point. This dividing point forms an output terminal.

Since the transistors Q1 and Q2 form the current mirror circuit, an electric current I1 (=I) flows to the transistor Q1, whereby a Zener voltage is generated at the cathode of the Zener diode D1. The Zener voltage is applied to the base of the transistor Q3 as a reference voltage, and an emitter output thereby generated at the transistor Q3 is voltage-divided by the resistors R1 and R2 and the diodes D2 and D3 to be outputted. In other words, the reference voltage generated at the cathode of the Zener diode D1 is mainly temperature-compensated between the base and the emitter of the transistor Q3 and by the diodes D2 and D3 and voltage-divided by the resistors R1 and R2, whereby a predetermined output voltage $V_{OUT}$ is outputted.

The output voltage $V_{OUT}$ is expressed as follows:

$$V_{OUT}=(V_Z-V_{BEQ3}-V_{FD2}-V_{FD3})\times\{R2/(R1+R2)\}+V_{FD2}+V_{FD3} \quad (1)$$

in which $V_Z$ represents the voltage of the Zener diode D1 (reference voltage), $V_{BEQ3}$ represents the base-to-emitter voltage of the transistor Q3, $V_{FD2}$ represents the forward voltage of the diode D2 and $V_{FD3}$ represents the forward voltage of the diode D3.

In the circuit as shown in FIG. 1, however, although the base potential of the transistor Q3 is secured by the Zener diode voltage $V_Z$, the collector potential of the transistor Q3 is changed following a change in the source voltage, whereby the transistor Q3 is subjected to a base width modulation effect, leading to a change in its emitter potential $V_Z-V_{BEQ3}$. As the result, the output voltage $V_{OUT}$ is changed.

More specifically, it is known that, with respect to a change in the source voltage by, e.g., 10 V, the emitter potential of the transistor Q3 is changed by about 2 to 3 mV in such a circuit. Thus, when such a constant-voltage circuit is used with a wide-ranging source voltage, the output voltage $V_{OUT}$ is changed considerably.

SUMMARY OF THE INVENTION

An object of the present invention is to provide a highly accurate and stable constant-voltage circuit in which connection of a transistor Q3 for output control is improved, so that the transistor Q3 is not subjected to a base width modulation effect and the emitter potential thereof is not changed following a change in the source voltage.

Thus, according to the present invention, there can be obtained a highly accurate and stable constant-voltage output circuit with simple circuit structure.

The above and other objects, features, aspects and advantages of the present invention will become more apparent from the following detailed description of the present invention when taken in conjunction with the accompanying drawings.

DESCRIPTION OF THE PREFERRED EMBODIMENTS

Figure 2:
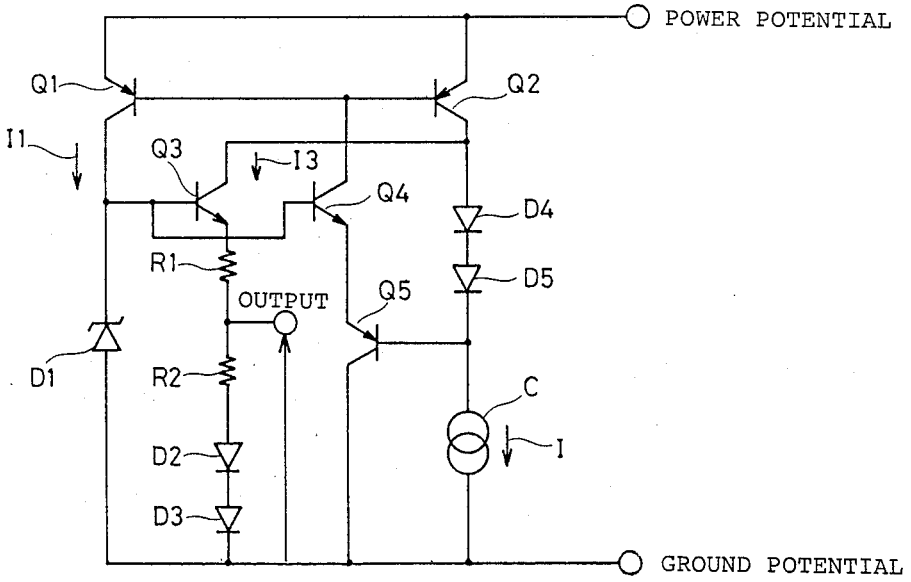
FIG. 2 is a circuit diagram showing a preferred embodiment of the present invention.

FIG. 2 is a circuit diagram showing a preferred embodiment of the present invention. The present embodiment is characterized in that transistors Q4 and Q5 and diodes D4 and D5 are further provided for improving connection of the collector of a transistor Q3 for output control.

Figure 1:
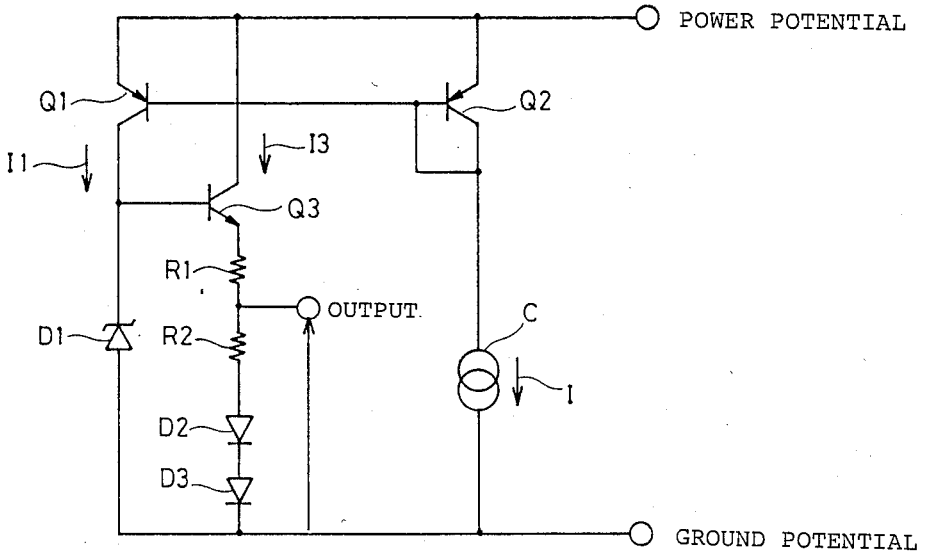
FIG. 1 PRIOR ART
FIG. 1 is a circuit diagram showing a typical example of a conventional constant-voltage circuit.

Referring to FIG. 2, transistors Q1, Q2 and Q5 are provided in identical polarity, e.g., being of pnp type, while transistors Q3 and Q4 are provided to be different in polarity from the transistors Q1, Q2 and Q5, e.g., to be of npn type. The collector of the output control transistor Q3 is connected with the collector of the transistor Q2, while series-connected diodes D4 and D5 are connected between the collector of the transistor Q2 and a constant-current source C. The diodes D4 and D5 are employed as step-down p-n junction elements. The transistors Q4 and Q5 which are different in polarity from each other are connected in series such that the collector of the transistor Q4 is connected with the bases of the transistors Q1 and Q2 and the base of the transistor Q4 is connected with the base of the transistor Q3. The base of the transistor Q5 is connected with the cathode of the diode D5, whose collector in turn is grounded. It is to be noted that the construction of other portions of this embodiment is identical to that of the conventional circuit as shown in FIG. 1 and thus explanation is omitted with respect to similar components shown in reference numerals identical to those in FIG. 1.

In the circuit as shown in FIG. 2, the collector potential $V_{CQ3}$ is expressed as follows:

$$V_{CQ3}=V_Z-V_{BEQ4}-V_{BEQ5}+V_{FD4}+V_{FD5} \quad (2)$$

in which $V_Z$ represents the voltage of the Zener diode D1 (reference voltage), $V_{BEQ4}$ represents the base-to-emitter voltage of the transistor Q4, $V_{BEQ5}$ represents the base-to-emitter voltage of the transistor Q5, $V_{FD4}$ represents the forward voltage of the diode D4 and $V_{FD5}$ represents the forward voltage of the diode D5.

From the p-n junction voltage drop characteristic of a semiconductor, $$V_{BEQ4} \approx V_{BEQ5} \approx V_{FD4} \approx V_{FD5} \ (\approx 0.6 \text{ to } 0.7 \text{ V})$$

whereby the above formula (2) is expressed as follows:

$$V_{CQ3} \approx V_Z \quad (3)$$

Thus, the collector-to-emitter voltage $V_{CEQ3}$ of the transistor Q3 is expressed from the formula (3) as follows:

$$V_{CEQ3} \approx V_{BEQ3} \quad (4)$$

That is, the collector-to-emitter voltage of the transistor Q3 is continuously clamped by the base-to-emitter voltage of the same. Therefore, even if the source voltage is changed, the transistor Q3 is not subjected to a base width modulation effect, and the emitter potential of the transistor Q3 is not changed. Thus, the output voltage $V_{OUT}$ of the circuit according to this embodiment as shown in FIG. 2 is not changed, whereby a stable constant-voltage output is compensated.

Figure 3:
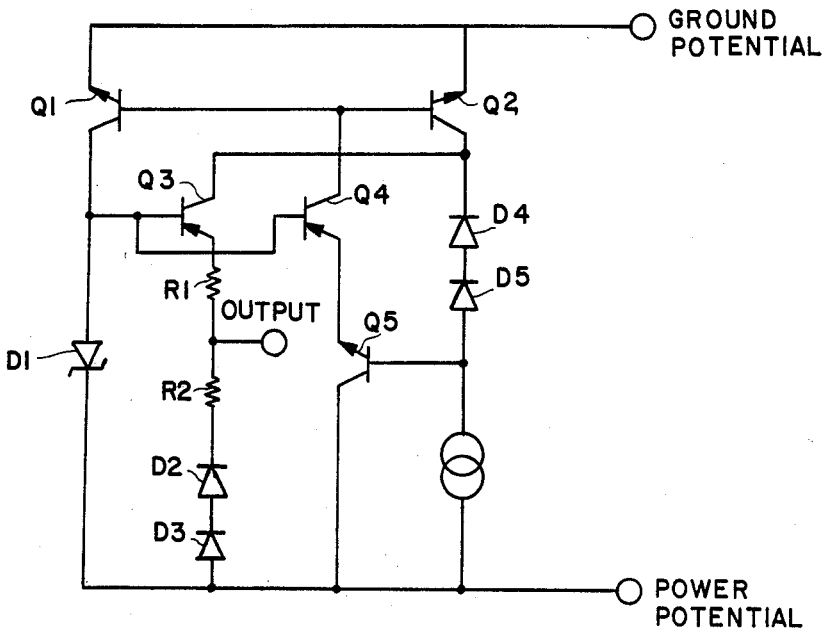
FIG. 3 is a circuit diagram showing an alternate embodiment of the present invention.

In another embodiment of the present invention, shown in FIG. 3, the power source (first reference potential) and the ground (second reference potential) may be reversed from the circuit configuration as shown in FIG. 2. In this case, the respective diodes D1, D2, D3, D4 and D5 are connected in the reverse direction, while the transistors Q1, Q2, Q3, Q4 and Q5 are reversed in polarity. In such a case, the output voltage characteristic remains unchanged except that the current flow is reversed.

In still another embodiment of the present invention, the Zener diode D1 may be replaced by another constant-voltage element or the like to be employed as a reference voltage generating means.

Further, other elements having a p-n junction, such as transistors, may be substituted for the diodes D4 and D5 employed as step-down junction elements.

Although a discrete circuit has been employed in the above description, it may be replaced by an integrated circuit having a similar function.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A constant-voltage circuit comprising:
a first reference potential;
a second reference potential being different in electric potential from said first reference potential;
a first transistor (Q1) of a first polarity having an emitter, a collector and a base, said emitter of said first transistor being connected to said first reference potential;
a second transistor (Q2) of said first polarity having an emitter, a collector and a base, said emitter of said second transistor being connected to said first reference potential with said base being connected to said base of said first transistor;
a reference voltage generating means (D1) connected between said collector of said first transistor and said second reference potential;
a third transistor (Q3) of a second polarity different from said first polarity having an emitter, a collector and a base, said base of said third transistor being connected to the junction between said reference voltage generating means and said first transistor, with said collector being connected to said collector of said second transistor;
a divider circuit (R1, R2, D2, D3) having a dividing point serving as an output terminal, said divider circuit being connected between said emitter of said third transistor and said second reference potential;
a p-n junction element (D4, D5) having one end and other end, said one end being connected to said collector of said second transistor;
a constant-current source (C) connected between said other end of said p-n junction element and said second reference potential; and
an active element (Q4, Q5) having a p-n junction, said p-n junction being connected between said base of said third transistor and said other end of said p-n junction element.

2. A constant-voltage circuit in accordance with claim 1, wherein
said reference voltage generating means is a Zener diode.

3. A constant-voltage circuit in accordance with claim 1, wherein
said divider circuit comprises a first resistor (R1), a second resistor (R2) and a p-n junction diode (D2 or D3) connected in series, with the junction between said first and second resistors serving as said dividing point.

4. A constant-voltage circuit in accordance with claim 3, wherein
a pair of said p-n junction diodes (D2, D3) are connected in series in a two-stage manner.

5. A constant-voltage circuit in accordance with claim 1, wherein
said p-n junction element is a p-n junction diode (D4, D5).

6. A constant-voltage circuit in accordance with claim 5, wherein
a pair of said p-n junction diodes are connected in series in a two-stage manner.

7. A constant-voltage circuit in accordance with claim 1, wherein
said first reference potential is a source potential,
said second reference potential is a ground potential,
said first and second transistors are of pnp type, and
said third transistor is of npn type.

8. A constant-voltage circuit in accordance with claim 7, wherein
said active element comprises:
an npn type fourth transistor (Q4) having an emitter, a collector and a base, and
a pnp type fifth transistor (Q5) having an emitter, a collector and a base,
said base of said fourth transistor being connected to said base of said third transistor, said collector of said fourth transistor being connected to the junction of interconnection of said bases of said first and second transistors, said emitter and said collector of said fifth transistor being connected between said emitter of said fourth transistor and said second reference potential, said base of said fifth transistor being connected to said other end of said p-n junction element (D5).

9. A constant-voltage circuit in accordance with claim 1, wherein said first reference potential is a ground potential, said second reference potential is a source potential, said first and second transistors are of npn type, and said third transistor is of pnp type.

10. A constant-voltage circuit in accordance with claim 9, wherein said active element comprises:

a pnp type fourth transistor having an emitter, a collector and a base, and an npn type fifth transistor having an emitter, a collector and a base, said base of said fourth transistor being connected to said base of said third transistor, said collector of said fourth transistor being connected to the junction of interconnection of said bases of said first and second transistors, said emitter and said collector of said fifth transistor being connected between said emitter of said fourth transistor and said second reference potential, said base of said fifth transistor being connected to said other end of said p-n junction element.

11. A constant-voltage circuit comprising a first reference potential; a second reference potential being different in electric potential from said first reference potential; first and second transistors (Q1, Q2) of identical polarity connected between said first reference potential and said second reference potential, said first and second transistors having emitters, collectors, and bases, respectively, a third transistor (Q3) for output control being different in polarity from said first and second transistors, said third transistor having an emitter, a collector and a base; a reference voltage generating means (D1); a constant-current source (C); and a divider circuit (R1, R2, D2, D3), said emitters of said first and second transistors (Q1, Q2) being respectively connected to said first reference potential, said bases of said first and second transistors being interconnected with each other, said collector of said first transistor being connected with said second reference potential through said reference voltage generating means, said collector of said second transistor being connected with said second reference voltage through said constant-current source and p-n junction element, said base of said third transistor being connected with said collector of said first transistor to be supplied with a predetermined voltage, said emitter of said third transistor being connected with said second reference potential through said divider circuit, a dividing point of said divider circuit forming an output terminal, said constant-voltage circuit further including a fourth transistor (Q4) being identical in polarity to said third transistor, said fourth transistor having an emitter, a collector and a base; a fifth transistor (Q5) being different in polarity from said third transistor, said fifth transistor having an emitter, a collector and a base; and a step-down p-n junction element (D4, D5), said collector of said third transistor (Q3) being connected to said collector of said second transistor (Q2), said step-down p-n junction element (D4, D5) being inserted and connected between said collector of said second transistor (Q2) and said constant-current source (C), said fourth transistor (Q4) and said fifth transistor (Q5) being connected in series, said collector of said fourth transistor (Q4) being connected to the junction of interconnection between said bases of said first and second transistors (Q1, Q2), said base of said fourth transistor (Q4) being connected to said base of said third transistor (Q3), said base of said fifth transistor (Q5) being connected to the junction between said step-down p-n junction element (D4, D5) and said constant-current source (C), said collector of said fifth transistor (Q5) being connected to said second reference potential.

12. A constant-voltage circuit in accordance with claim 11, wherein said first reference potential is a source potential, said second reference potential is a ground potential, said first transistor, said second transistor and said fifth transistor are of pnp type in polarity, and said third transistor and said fourth transistor are of npn type in polarity.

13. A constant-voltage circuit in accordance with claim 11, wherein said first reference potential is a ground potential, said second reference potential is a source potential, said first transistor, said second transistor and said fifth transistor are of npn type in polarity, and said third transistor and said fourth transistor are of pnp type in polarity.

14. A constant-voltage circuit in accordance with claim 11, wherein said divider circuit comprises a first resistor, a second resistor and a p-n junction diode connected in series, and the junction between said first and second resistors serves as a dividing point.

15. A constant-voltage circuit in accordance with claim 14, wherein a pair of said p-n junction diodes are connected in series in a two stage manner.

16. A constant-voltage circuit in accordance with claim 11, wherein said step-down p-n junction element comprises two p-n junction diodes connected in series.

* * * * *